US005966833A

United States Patent [19]

Andis et al.

[11] Patent Number: 5,966,833

[45] **Date of Patent: *Oct. 19, 1999**

[54] HAIR DRYER WITH REMOVABLE CONCENTRATOR

[75] Inventors: Matthew L. Andis; Thomas C. Maddocks, both of Racine, Wis.

[73] Assignee: Andis Company, Racine, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/876,570

[22] Filed: Jun. 16, 1997

[51] Int. Cl.[6] ..... F26B 21/06

[52] U.S. Cl. ..... 34/97; 34/283

[58] Field of Search ..... 34/97, 283

[56] References Cited

U.S. PATENT DOCUMENTS

| | | | |
|---|---|---|---|
| 4,538,362 | 9/1985 | Andis | 34/97 |
| 5,572,800 | 11/1996 | West | 34/97 |
| 5,649,370 | 7/1997 | Russo | 34/97 |

*Primary Examiner*—Ronald C. Capossela

*Attorney, Agent, or Firm*—Michael, Best & Friedrich LLP

[57] ABSTRACT

Disclosed herein is a hair blower assembly comprising a hair blower comprising a barrel including a discharge portion having an outer surface, and a concentrator removeably mounted on the discharge portion and including an inner surface telescopically surrounding the outer surface of the discharge portion, and a pad of resilient plastic material fixed on the inner surface and grippingly engaging the outer surface of the discharge portion to prevent relative movement between the barrel and the concentrator in the absence of manual manipulation to remove the concentrator from the barrel.

24 Claims, 1 Drawing Sheet

HAIR DRYER WITH REMOVABLE CONCENTRATOR

BACKGROUND OF THE INVENTION

The invention relates generally to hair dryers or blowers and to hair dryer or blower assemblies and to removable attachments for such hair dryers or blowers, such as a diffuser or a concentrator.

Attention is directed to U.S. Pat. No. 4,538,362 issued Sep. 3, 1985.

SUMMARY OF THE INVENTION

The invention provides a hair blower comprising a barrel including a discharge portion having an outer surface, and an attachment removeably mounted on the discharge portion and including an inner surface telescopically surrounding the outer surface of the discharge portion, and a pad of resilient plastic material fixed on one of the inner surface of the attachment and the outer surface of the discharge portion of the barrel and grippingly engaging the other of the inner surface of the attachment and the outer surface of the discharge portion of the barrel.

The invention also provides a hair blower assembly comprising a hair blower including a barrel having a discharge portion with a cylindrical outer surface, and a concentrator removeably mounted on the discharge portion and including an cylindrical inner surface telescopically surrounding the cylindrical outer surface of the discharge portion and including a plurality of circumferentially spaced and axially extending ribs having a height extending inwardly from the cylindrical inner surface, a first pad of resilient foam plastic material which is fixed on the cylindrical inner surface between a first adjacent pair of the plurality of ribs, and which has a height which, when relaxed, is greater than the height of the ribs, and which, when the concentrator is mounted on the barrel, is resiliently reduced so that the first pad grippingly engages the cylindrical outer surface of the discharge portion to prevent relative movement between the barrel and the concentrator in the absence of manual manipulation to remove the concentrator from the barrel, and a second pad of resilient foam plastic material which is fixed on the cylindrical inner surface in generally diametrically opposite relation to the first mentioned pad and between a second adjacent pair of the plurality of ribs, and which has a height which, when relaxed, is greater than the height of the ribs, and which, when the concentrator is mounted on the barrel, is resiliently reduced so that the second pad grippingly engages the cylindrical outer surface of the discharge portion to prevent relative movement between the barrel and the concentrator in the absence of manual manipulation to remove the concentrator from the barrel.

The invention also provides an attachment adapted to be removeably mounted on a hair blower including a barrel having a discharge portion with an outer surface, the attachment comprising an inner surface telescopically surrounding the outer surface of the discharge portion, and a pad of resilient plastic material fixed on the inner surface and adapted to grippingly engage the outer surface of the discharge portion to prevent relative movement between the barrel and the attachment in the absence of manual manipulation to remove the attachment from the barrel.

The invention also provides a concentrator adapted to be removeably mounted on a hair blower including a barrel having a discharge portion with a cylindrical outer surface, the concentrator comprising a cylindrical inner surface telescopically surrounding the cylindrical outer surface of the discharge portion and including a plurality of circumferentially spaced and axially extending ribs having a height extending inwardly from the cylindrical inner surface, a first pad of resilient foam plastic material which is fixed on the cylindrical inner surface between a first adjacent pair of the plurality of ribs, and which has a height which, when relaxed, is greater than the height of the ribs, and which, when the concentrator is mounted on the barrel, is resiliently reduced so that the first pad grippingly engages the cylindrical outer surface of the discharge portion to prevent relative movement between the barrel and the concentrator in the absence of manual manipulation to remove the concentrator from the barrel, and a second pad of resilient foam plastic material which is fixed on the cylindrical inner surface in generally diametrically opposite relation to the first mentioned pad and between a second adjacent pair of the plurality of ribs, and which has a height which, when relaxed, is greater than the height of the ribs, and which, when the concentrator is mounted on the barrel, is resiliently reduced so that the second pad grippingly engages the cylindrical outer surface of the discharge portion to prevent relative movement between the barrel and the concentrator in the absence of manual manipulation to remove the concentrator from the barrel.

Other features and advantages of the invention will become apparent to those skilled in the art upon review of the following detailed description, claims and drawings.

Figure 1:
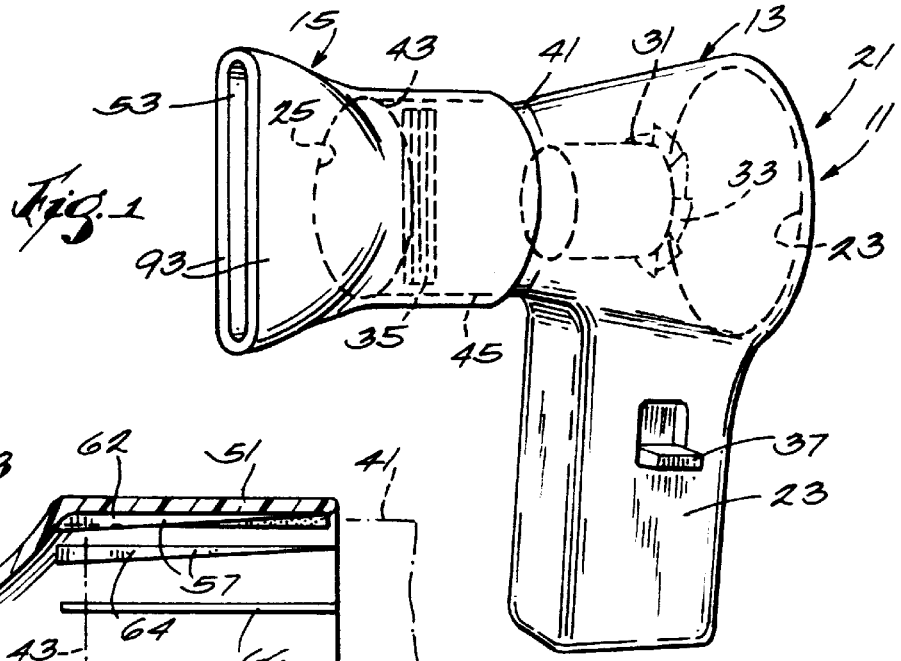
FIG. 1 is a perspective view of an assembly of a hair dryer or blower and a concentrator, which assembly incorporates various of the features of the invention.
Figure 3:
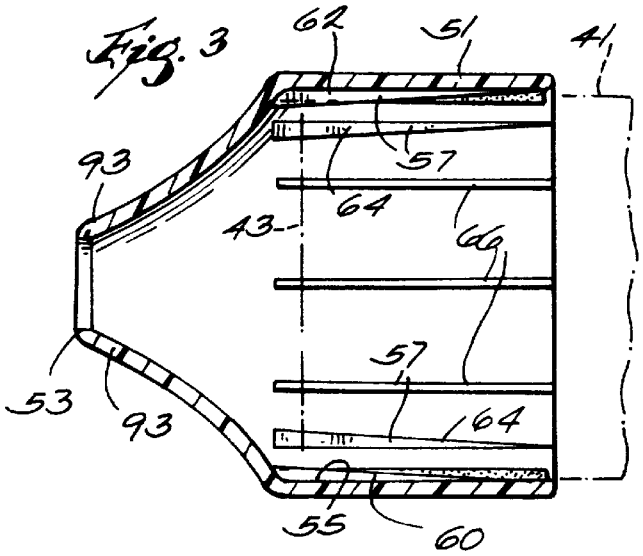
FIG. 3 is a sectional view of the concentrator included in the assembly shown in FIG. 1, which view is taken along line 3—3 of FIG. 2, and with a portion of the hair dryer or blower shown in dotted outline.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in FIG. 1 of the drawings is a hair dryer or blower assembly 11 including a hair dryer or blower 13 and a removable attachment 15 such as, for instance, a diffuser or a concentrator. In FIG. 1, the removable attachment 15 is a concentrator which is removably mounted on the hair blower 13.

The hair dryer or blower 13 can be of any conventional construction and, in the construction illustrated in the drawings, includes a housing 21 and an elongated handle 23 connected to the housing 21. The housing 21 is hollow and defines a straight-line air pathway through the housing 21 between a circular air inlet 23 and a circular air outlet 25. Supported in the straight-line air pathway by the housing 21 is an electrical motor 31, a turbo fan 33 rotatable by the electrical motor 31, and means for heating the air as it passes along the straight-line air pathway in the form of electrical heating elements 35. Means are also provided for connecting the electrical motor 31 and the electrical heating elements 35 to a source of power supply. The hair dryer or blower 13 also includes a switch 37 for turning on and off the electrical motor 31 and the electric heating elements 35, and for providing different air speeds through the air dryer or blower 13.

In the specifically disclosed and preferred construction, the housing 21 includes a barrel 41 extending between the air inlet 23 and the air outlet 25 and having, adjacent the air outlet 25, a discharge portion 43 which extends from the air outlet 25 and which has an outer surface 45 which is preferably cylindrical, but which can be of other configurations, such as, for instance, a conical configuration.

As is well known, the hair dryer or blower 13 is operative to direct or discharge a flow of heated air through the discharge portion 43 and through the air outlet 25.

The removable attachment or concentrator 15 is preferably fabricated of substantially rigid plastic, is generally hollow, and includes a hollow entry or inlet portion 51 and a hollow discharge or outlet portion 53. The entry portion 51 is preferably cylindrical to afford telescopic engagement over the discharge portion 43 of the barrel 41 of the hair dryer or blower 13. However, other configurations could be employed so long as such configurations permit assembly in mating telescopic relation of the hollow entry portion 51 with the configuration of the outer surface 45 of the discharge portion 53 of the barrel 5.

More particularly, the entry portion 51 of the concentrator 15 includes a cylindrical inner surface 55 which has an inner diameter somewhat larger than the outer diameter of the outer surface 45 of the discharge barrel portion 43, and which, when assembled on the discharge portion 43 of the hair dryer or blower 13, telescopically surrounds the cylindrical outer surface 45 of the discharge portion 43.

The entry portion 51 of the concentrator 15 also includes a plurality of circumferentially spaced and axially extending ribs 57 which have respective inner edges 59 and a height extending between the cylindrical inner surface 55 and the inner edges 59. Various rib constructions can be employed.

Figure 4:
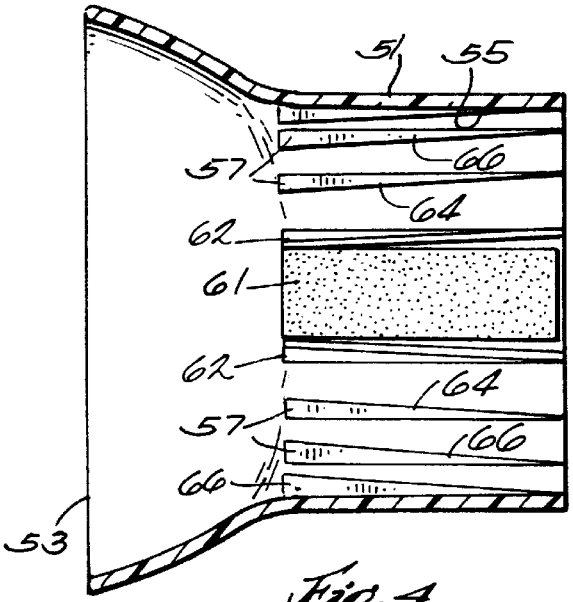
FIG. 4 is a sectional view of the concentrator included in the assembly shown in FIG. 1, which view is taken along line 4—4 of FIG. 2.
Figure 2:
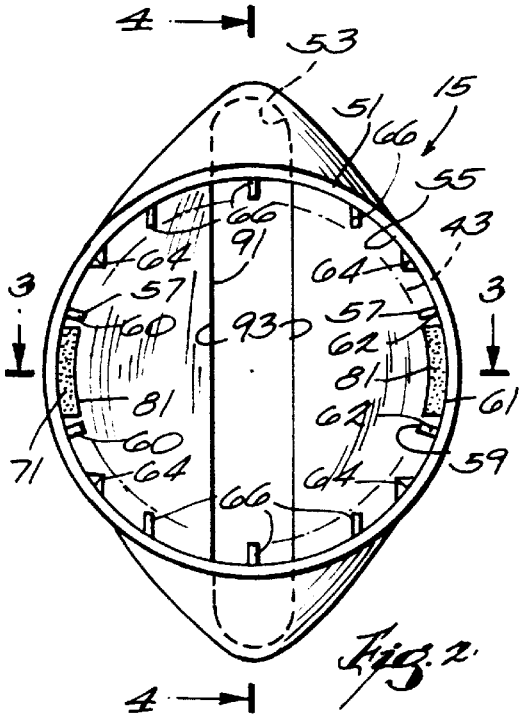
FIG. 2 is an enlarged end view of the concentrator included in the assembly shown in FIG. 1, which view is taken from the right end of the concentrator as shown in FIG. 1.

In the specifically disclosed construction, the plurality of ribs 57 includes a first pair of adjacently and circumferentially spaced ribs 60 which extend generally radially and which gradually increase in height in the direction toward the discharge portion 53 of the barrel 51 from the end of the concentrator shown to the right in FIG. 4.

The plurality of ribs 57 also includes a similar second pair of adjacently and circumferentially spaced ribs 62 which are located in generally diametrically opposite relation to the first pair of ribs 60. The second pair of ribs 62 also extend generally radially and gradually increase in height in the direction toward the discharge portion 53 from the end of the concentrator shown to the right in FIG. 4.

In addition, the plurality of ribs 57 also includes, in respectively circumferentially adjacently spaced relation from the first and second pair of ribs 60 and 62, four additional ribs 64 which also extend generally radially and which gradually increase in height in the direction toward the discharge portion 53 from the end of the concentrator shown to the right in FIG. 4.

Still further in addition, the plurality of ribs 57 also include six additional ribs 66 which are located between the ribs 64, which extend in generally parallel relation to the lengthwise elongation of the discharge portion 53 and in circumferentially spaced relation to one another, and which gradually increase in height in the direction toward the discharge portion 53 from the end of the concentrator shown to the right in FIG. 4.

The gradual increase in height of the ribs 60, 62, 64, and 66 facilitates telescopic engagement of the concentrator 15 on the barrel 51.

In addition, the entry portion 51 of the concentrator 13 includes a first pad 61 of resilient plastic material which is preferably foamed and which is fixed on the cylindrical inner surface 55 between the first adjacent pair of ribs 60. The first resilient pad 61 has a height which, in general, and when relaxed, is greater than the height of the ribs 57, and which, when the concentrator 15 is mounted on the discharge portion 43 of the barrel 41, is resiliently reduced so that the first pad 61 grippingly engages the cylindrical outer surface 45 of the discharge portion 43 to prevent relative movement between the barrel 41 and the concentrator 15 in the absence of manual manipulation by the user to remove the concentrator 15 from the barrel 41.

In the preferred construction, the inlet or entry portion 51 of the concentrator 15 also includes a second pad 71 of resilient plastic material which is preferably foamed, which is fixed on the cylindrical inner surface 55 in generally diametrically opposite relation to the first pad 61 and between the second adjacent pair of ribs 62, and which has a height which, in general, and when relaxed, is greater than the height of the ribs 57, and which, when the concentrator 15 is mounted on the barrel 41, is resiliently reduced so that the second pad 71 grippingly engages the cylindrical outer surface 45 of the discharge portion 43 to prevent relative movement between the barrel 41 and the concentrator 15 in the absence of manual manipulation by the user to remove the concentrator 15 from the barrel 41.

Each of the pads 61 and 71 includes an inner surface 81 which, when the concentrator 15 is assembled on the hair dryer or blower 13, grasps or grippingly engages the outer surface 45 of the barrel discharge portion 43. If desired more than two resilient pads can be employed. In the specifically disclosed construction, the height of the pads 61 and 71 is approximately equal to the height of the ends of the ribs 57 adjacent the discharge portion 53.

Thus, in general, the diametric distance between the inner edges 59 of the ribs 57 is somewhat less than the diameter of the outer surface 45 of the discharge portion 43 of the hair dryer barrel 41. In addition, when relaxed, the diametric distance between the inner surfaces 81 of the opposing pads 61 and 71 is less than the diametric distance between the inner edges 59 of the opposing ribs 57 and is slightly greater than the diameter of the cylindrical outer surface 45 of the discharge portion 43 of the barrel 41 of the hair dryer or blower 13, whereby the pads 61 and 71 are resiliently reduced in height consequent to assembly of the concentrator 15 on the hair dryer or blower 13, thus producing the desired grip of the pads 61 and 71 on the discharge portion 43 of the barrel 41 of the hair dryer or blower 13.

In other words, the outer surface 45 of the discharge portion 43 of the barrel 41 has a diameter, and the ribs 57 have respective inner edges 59 which, in general, are spaced apart at a diametrical distance greater than the diameter of the outer surface 45 of the discharge portion 43 of the barrel 41. Still further in addition, the first and second pads 61 and 71 have respective relaxed heights greater than the height of the ribs 57 and the inner surfaces 81 thereof are spaced apart, when the pads 61 and 71 are relaxed, at a diametrical distance less than the diameter of the outer surface 45 of the discharge portion 43 of the barrel 41.

In still other words, the cylindrical outer surface 45 of the discharge portion 43 has an axis and extends at a first radius from the axis. In addition, in general, the inner edges 59 of the ribs 57 are located at a second radius from the axis, which second radius is slightly less than the first radius. Still further in addition, the inner surfaces 81 of the resilient pads 61 and 71 are located, when the pads 61 and 71 are relaxed, at a third radius from the axis, which third radius is somewhat greater than the first radius. Still further in addition, when the concentrator 15 is assembled on the discharge portion 43 of the barrel 41 of the hair blower or dryer 13, the resilient pads 61 and 71 are resiliently collapsed or reduced in height, and substantially the entire area of the inner surfaces 81 grip the cylindrical outer surface 45 of the discharge portion 43.

As illustrated the drawings, the hollow discharge portion 53 of the concentrator 15 includes an elongated discharge opening 91 which has an cross-sectional area considerably less than the cross-sectional area of the inlet portion. As shown, the discharge portion 53 of the concentrator 15 is principally defined by two generally flat and opposing surfaces 93 which extend from the cylindrical entry portion 51 and which converge to form the discharge opening 91.

As a consequence of the disclosed construction, the grip of the resilient pads 61 and 71 on the discharge portion 43 of the hair dryer barrel 41 is sufficient to reliably hold or retain the concentrator 15 in fixed relative position on the hair dryer barrel 41 while, at the same time, is insufficient to prevent manual manipulation by a user to effect removal of the concentrator 15 from the hair dryer barrel 41 and subsequent reassembly.

While the disclosed construction has involved the employment of the concentrator 15, it is to be understood that other attachments, such as a diffuser (not shown) are within the scope of the invention.

Various of the features are set forth in the following claims.

We claim:

1. A hair blower comprising a barrel including a discharge portion having an outer surface, and an attachment removeably mounted on said discharge portion and including an inner surface telescopically surrounding said outer surface of said discharge portion, and a pad of resilient plastic material fixed on one of said inner surface of said attachment and said outer surface of said discharge portion of said barrel and grippingly engaging the other of said inner surface of said attachment and said outer surface of said discharge portion of said barrel.

2. A hair blower in accordance with claim 1 wherein said attachment is a concentrator, and wherein said plastic material is a foam plastic material.

3. A hair blower in accordance with claim 1 wherein said outer surface of said discharge portion of said barrel is cylindrical, and wherein said inner surface of said attachment is cylindrical.

4. A hair blower in accordance with claim 1 wherein said inner surface of said attachment includes a pair of circumferentially spaced and axially extending ribs, and wherein said pad is located between said pair of said circumferentially spaced ribs.

5. A hair blower in accordance with claim 4 wherein said outer surface of said discharge portion of said barrel is cylindrical, wherein said inner surface of said attachment is cylindrical, wherein said ribs have a height extending inwardly from said cylindrical inner surface, and wherein said pad has a relaxed height greater than said height of said ribs.

6. A hair blower in accordance with claim 5 wherein said height of said pad is resiliently reduced incident to mounting of said attachment on said discharge portion of said barrel.

7. A hair blower in accordance with claim 5 wherein said cylindrical inner surface of said attachment includes a plurality of circumferentially spaced and axially extending ribs, wherein said first mentioned pad is located between a first adjacent pair of said plurality of ribs, and wherein a second pad of resilient plastic material is fixed on said cylindrical inner surface in generally diametrically opposite relation to said first mentioned pad and between a second adjacent pair of said plurality of ribs, and grippingly engages said cylindrical outer surface of said discharge portion to prevent relative movement between the barrel and said attachment in the absence of manual manipulation to remove said attachment from the barrel.

8. A hair blower in accordance with claim 7 wherein said outer surface of said discharge portion of said barrel has a diameter, wherein said ribs have a height extending inwardly from said cylindrical inner surface, and respective inner edges spaced apart at a diametrical distance less than the diameter of said outer surface of said discharge portion of said barrel, and wherein said first and second pads have respective relaxed heights greater than said height of said ribs and have inner surfaces which, when said pads are relaxed, are spaced apart at a diametrical distance greater than the diameter of said outer surface of said discharge portion of said barrel.

9. A hair blower assembly comprising a hair blower including a barrel having a discharge portion with a cylindrical outer surface, and a concentrator removeably mounted on said discharge portion and including a cylindrical inner surface telescopically surrounding said cylindrical outer surface of said discharge portion and including a plurality of circumferentially spaced and axially extending ribs having a height extending inwardly from said cylindrical inner surface, a first pad of resilient foam plastic material which is fixed on said cylindrical inner surface between a first adjacent pair of said plurality of ribs, and which has a height which, when relaxed, is greater than said height of said ribs, and which, when said concentrator is mounted on said barrel, is resiliently reduced so that said first pad grippingly engages said cylindrical outer surface of said discharge portion to prevent relative movement between said barrel and said concentrator in the absence of manual manipulation to remove said concentrator from said barrel, and a second pad of resilient foam plastic material which is fixed on said cylindrical inner surface in generally diametrically opposite relation to said first mentioned pad and between a second adjacent pair of said plurality of ribs, and which has a height which, when relaxed, is greater than said height of said ribs, and which, when said concentrator is mounted on said barrel, is resiliently reduced so that said second pad grippingly engages said cylindrical outer surface of said discharge portion to prevent relative movement between said barrel and said concentrator in the absence of manual manipulation to remove said concentrator from said barrel.

10. A hair blower in accordance with claim 9 wherein said outer surface of said discharge portion of said barrel has a diameter, wherein said ribs have a height extending inwardly from said cylindrical inner surface, and respective inner edges spaced apart at a diametrical distance less than the diameter of said outer surface of said discharge portion of said barrel, and wherein said first and second pads have respective relaxed heights greater than said height of said ribs and have inner surfaces which, when said pads are relaxed, are spaced apart at a diametrical distance greater than the diameter of said outer surface of said discharge portion of said barrel.

11. An attachment adapted to be removeably mounted on a hair blower including a barrel having a discharge portion with an outer surface, said attachment comprising an inner surface telescopically surrounding the outer surface of the discharge portion, and a pad of resilient plastic material fixed on said inner surface and adapted to grippingly engage the outer surface of the discharge portion to prevent relative movement between the barrel and said attachment in the absence of manual manipulation to remove said attachment from the barrel.

12. An attachment in accordance with claim 11 wherein said attachment is a concentrator, and wherein said plastic material is a foam plastic material.

13. A hair blower in accordance with claim 11 wherein said outer surface of said discharge portion of said barrel is cylindrical, and wherein said inner surface of said attachment is cylindrical.

14. An attachment in accordance with claim 11 wherein said inner surface of said attachment includes a pair of circumferentially spaced and axially extending ribs, and wherein said pad is located between said pair of said circumferentially spaced ribs.

15. An attachment in accordance with claim 14 wherein said inner surface of said attachment is cylindrical, wherein said ribs have a height extending inwardly from said cylindrical inner surface, and wherein said pad has a relaxed height greater than said height of said ribs.

16. An attachment in accordance with claim 15 wherein said height of said pad is resiliently reduced incident to mounting of said attachment on said barrel.

17. An attachment in accordance with claim 11 wherein said cylindrical inner surface of said attachment includes a plurality of circumferentially spaced and axially extending ribs, wherein said first mentioned pad is located between a first adjacent pair of said plurality of ribs, and wherein a second pad of resilient plastic material is fixed on said cylindrical inner surface in generally diametrically opposite relation to said first mentioned pad and between a second adjacent pair of said plurality of ribs, and grippingly engages the cylindrical outer surface of the discharge portion to prevent relative movement between the barrel and said attachment in the absence of manual manipulation to remove said attachment from the barrel.

18. An attachment in accordance with claim 17 wherein said outer surface of said discharge portion of said barrel has a diameter, wherein said ribs have a height extending inwardly from said cylindrical inner surface, and respective inner edges spaced apart at a diametrical distance less than the diameter of said outer surface of said discharge portion of said barrel, and wherein said first and second pads have respective relaxed heights greater than said height of said ribs and have inner surfaces which, when said pads are relaxed, are spaced apart at a diametrical distance greater than the diameter of said outer surface of said discharge portion of said barrel.

19. A concentrator adapted to be removeably mounted on a hair blower including a barrel having a discharge portion with a cylindrical outer surface, said concentrator comprising an cylindrical inner surface telescopically surrounding the cylindrical outer surface of the discharge portion and including a plurality of circumferentially spaced and axially extending ribs having a height extending inwardly from said cylindrical inner surface, a first pad of resilient foam plastic material which is fixed on said cylindrical inner surface between a first adjacent pair of said plurality of ribs, and which has a height which, when relaxed, is greater than said height of said ribs, and which, when said concentrator is mounted on the barrel, is resiliently reduced so that said first pad grippingly engages the cylindrical outer surface of the discharge portion to prevent relative movement between said barrel and said concentrator in the absence of manual manipulation to remove said concentrator from the barrel, and a second pad of resilient foam plastic material which is fixed on said cylindrical inner surface in generally diametrically opposite relation to said first mentioned pad and between a second adjacent pair of said plurality of ribs, and which has a height which, when relaxed, is greater than said height of said ribs, and which, when said concentrator is mounted on the barrel, is resiliently reduced so that said second pad grippingly engages the cylindrical outer surface of the discharge portion to prevent relative movement between said barrel and said concentrator in the absence of manual manipulation to remove said concentrator from the barrel.

20. A concentrator in accordance with claim 19 wherein said outer surface of said discharge portion of said barrel has a diameter, wherein said ribs have a height extending inwardly from said cylindrical inner surface, and respective inner edges spaced apart at a diametrical distance less than the diameter of said outer surface of said discharge portion of said barrel, and wherein said first and second pads have respective relaxed heights greater than said height of said ribs and have inner surfaces which, when said pads are relaxed, are spaced apart at a diametrical distance greater than the diameter of said outer surface of said discharge portion of said barrel.

21. A hair blower comprising a barrel including a discharge portion having an endless surface, and an attachment removeably mounted on said discharge portion and including an endless surface in telescopic engagement with said endless surface of said discharge portion, and resilient material between said endless surface of said attachment and said endless surface of said discharge portion of said barrel so that when said concentrator is mounted on said barrel, said pad prevents relative movement between said barrel and said concentrator in the absence of manual manipulation to remove said concentrator from said barrel.

22. A hair blower assembly comprising a hair blower including a barrel having a discharge portion with an annular surface, and a concentrator removeably mounted on said discharge portion and including an annular surface telescopically surrounding said annular surface of said discharge portion and including a plurality of circumferentially spaced and axially extending ribs, and a pad of resilient foam plastic material which is fixed on said annular surface of said concentrator between an adjacent pair of said plurality of ribs and which, when said concentrator is mounted on said barrel, is resiliently reduced so that said pad grippingly engages said annular surface of said discharge portion to prevent relative movement between said barrel and said concentrator in the absence of manual manipulation to remove said concentrator from said barrel.

23. An attachment adapted to be removeably mounted on a hair blower including a barrel having a discharge portion with an endless surface, said attachment comprising an endless surface adapted to telescopically engage the annular surface of the discharge portion, and resilient material fixed on said endless surface of said attachment and adapted to grippingly engage the endless surface of the discharge portion to prevent relative movement between the barrel and said attachment in the absence of manual manipulation to remove said attachment from the barrel.

24. A concentrator adapted to be removeably mounted on a hair blower including a barrel having a discharge portion with an annular surface, said concentrator comprising an annular inner surface telescopically surrounding the annular surface of the discharge portion and including a plurality of circumferentially spaced and axially extending ribs, a pad of resilient foam plastic material which is fixed on said annular surface of said attachment between an adjacent pair of said plurality of ribs and which, when said concentrator is mounted on the barrel, is resiliently reduced so that said pad grippingly engages the annular surface of the discharge portion to prevent relative movement between said barrel and said concentrator in the absence of manual manipulation to remove said concentrator from the barrel.

* * * * *

UNITED STATES PATENT AND TRADEMARK OFFICE

CERTIFICATE OF CORRECTION

PATENT NO : 5,966,833

DATED : October 19, 1999

INVENTOR(S) : Matthew L. Andis and Thomas C. Maddocks

It is certified that error appears in the above-identified patent and that said Letters Patent is hereby corrected as shown below:

Claim 7, column 6, line 19, after "ribs" delete the comma (,).

Claim 8, column 6, line 33, delete "greater" and insert --less--.

Claim 10, column 7, line 7, delete "greater" and insert --less--.

Claim 18, column 7, line 62, delete "greater" and insert --less--.

Claim 19, column 8, line 1, delete "an" and insert --a--.

Claim 20, column 8, line 36, delete "greater" and insert --less--.

Claim 21, column 8, line 46, after "that" insert --,--, and
line 47, delete "pad" and insert --resilient material--.

Signed and Sealed this

Twenty-first Day of November, 2000

*Attest:*

Q. TODD DICKINSON

*Attesting Officer*

*Director of Patents and Trademarks*